US005336334A

United States Patent [19]

Johnson

[11] Patent Number: 5,336,334

[45] Date of Patent: Aug. 9, 1994

[54] METHOD FOR CLEANSING A PORTABLE KEG TAP

[75] Inventor: Samuel O. Johnson, Statesboro, Ga.

[73] Assignee: Universal EPSCO, Inc., Atlanta, Ga.

[21] Appl. No.: 912,881

[22] Filed: Jul. 13, 1992

[51] Int. Cl.[5] ..... B08B 3/00; B08B 9/00

[52] U.S. Cl. ..... 134/22.12; 134/22.18; 134/22.1; 134/22.11; 134/169 C; 222/148; 137/238

[58] Field of Search ..... 222/148; 137/240, 238; 134/169 C, 169 R, 22.12, 22.18, 22.1, 22.11; 239/112, 113, 106, 104

[56] References Cited

U.S. PATENT DOCUMENTS

| | | | |
|---|---|---|---|
| 2,645,524 | 7/1953 | Kelly | 239/112 |
| 3,036,741 | 5/1962 | Hilts | 222/148 |
| 3,733,840 | 5/1973 | Pearl et al. | 222/148 X |
| 4,465,210 | 8/1984 | Iwanami | 222/148 |
| 4,549,676 | 10/1985 | Gerich | 239/112 X |
| 4,572,230 | 2/1986 | Mirabile | 222/148 X |
| 4,582,226 | 4/1986 | Doak | 222/148 |
| 4,606,476 | 8/1986 | Pocock et al. | 222/148 |
| 4,746,063 | 5/1988 | Roberts | 239/112 X |
| 4,821,764 | 4/1989 | Brenez | 137/238 |
| 4,941,593 | 7/1990 | Hicks et al. | 222/148 |
| 5,060,860 | 10/1991 | Megerle | 239/112 X |

*Primary Examiner*—Andres Kashnikow
*Assistant Examiner*—Anthoula Pomrening
*Attorney, Agent, or Firm*—Hopkins & Thomas

[57] ABSTRACT

A cleaning apparatus cleanses a portable keg tap for a keg of a beverage, such as beer. A keg tap coupling has an orifice which emulates a fluid outlet orifice of a keg. The keg tap coupling is connected to the inlet of a portable keg tap. A cleaning fluid coupling is disposed to connect to a cleaning fluid source, for example, a water spigot or water outlet from a water heater. A fluid regulator regulates the fluid pressure of the cleaning fluid flowing from the cleaning fluid source. A shut-off valve is used to selectively initiate and terminate the flow of cleaning fluid flowing from the cleaning fluid source. As a result, a portable keg tap can be efficiently cleaned and sanitized.

1 Claim, 1 Drawing Sheet

METHOD FOR CLEANSING A PORTABLE KEG TAP

FIELD OF THE INVENTION

The present invention generally relates to keg taps for dispensing fluids, for example, beer or other beverages, from a keg, and more particularly, to a cleaning apparatus and method for cleansing a portable keg tap.

RELATED ART

Well known in the art are various types of portable keg taps for dispensing fluids, such as beer, wine, soda, water, and other beverages, stored in kegs. Generally, as an example, FIG. 1 illustrates a conventional portable keg tap 11 having an inlet 13 for connection to a keg outlet orifice, a controllable dispensing outlet 15 with dispensing lever 17 for dispensing the keg fluid, and a pump apparatus 21 with pump handle 23 for injecting air or other gas into the keg to provide dispensing force. The portable keg tap 11 is affixed to the keg via an appropriate latching mechanism 25. Many other conventional keg tap configurations are known in the art, but all have the foregoing essential attributes and are applicable to the discussion herein.

As the keg taps are repeatedly used and moved from keg to keg, bacteria, fungus, and/or other foreign materials build up in the fluid passage ways of the keg tap. This build-up of foreign materials is unsanitary and can adversely affect the taste, aroma, and appearance of the dispensed fluid. As a result, after extensive use, the keg taps are discarded, or tediously disassembled, cleaned, and reassembled, or disassembled for salvage parts. More times than not, the keg taps are discarded as garbage as they are a low cost item.

The need to periodically clean beer lines in taverns was recognized at least as early as 1904. In U.S. Pat. No. 774,461, P. Wolfe disclosed an apparatus for cleaning beer, ale, and water pipes. This device, which was carried on a movable frame, contained a water tank, a "combined compressed air and solution tank," and an air pump.

As time progressed, many other cleaning apparatuses for cleansing beer and other beverage lines were developed. For example, such cleaning apparatuses and the evolution thereof are described in the following U.S. patents, which are incorporated herein by reference as if set forth in full hereinbelow: U.S. Pat. No. 2,443,556 to M. J. Zwosta, U.S. Pat. No. 2,443,550 to M. J. Zwosta, U.S. Pat. No. 2,583,982 to M. J. Zwosta, U.S. Pat. No. 2,645,379 to B. Audia, U.S. Pat. No. 4,527,585 to Mirabile, U.S. Pat. No. 4,572,230 to Mirabile, U.S. Pat. No. 4,941,593 to Hicks, and U.S. Pat. No. 5,090,440 to Ladouceur et al.

Although the cleaning apparatuses of the prior art provide for the sanitizing of fluid lines in sophisticated beverage dispensing systems, which are generally permanently installed in taverns or other eating establishments, there is a heretofore unaddressed need in the industry for a cleaning apparatus and method directed to cleansing the fluid passage ways of a portable keg tap.

SUMMARY OF THE INVENTION

Accordingly, an object of the present invention is to provide a cleaning apparatus and method for cleansing a portable keg tap.

Another object of the present invention is to provide an apparatus and method for permitting the cleaning of fluid passage ways of a keg tap with cleansing solvents, other reactive chemical solutions, and/or high temperature cleaning fluids.

Another object of the present invention is to provide an apparatus and method for enhancing the longevity of a keg tap.

Another object of the present invention is to provide an apparatus and method for enhancing the taste, aroma, and appearance of fluid dispensed from a keg with a keg tap.

Another object of the present invention is to provide an apparatus and method for permitting variable fluid force and thrust through a keg tap to enhance cleansing effect.

Another object of the present invention is to provide a cleaning apparatus for a portable keg tap which is inexpensive to manufacture, easy to implement, and effective in operation.

Briefly stated, the present invention is a cleaning apparatus for a portable keg tap. The present invention comprises a coupling means for receiving cleaning fluid from a cleaning fluid source and for delivering the cleaning fluid to an inlet of the keg tap. A fluid regulator means regulates the flow rate of the cleaning fluid through the coupling means. In addition, a valve means may be disposed within the coupling means for selectively initiating and terminating the flow of the cleaning fluid.

In a preferred embodiment of the present invention, the cleaning apparatus has a keg tap coupling with an orifice which emulates a fluid outlet orifice of a keg. A cleaning fluid coupling is adapted to connect to a cleaning fluid source, for example, a water spigot 12. A fluid regulator is adapted to regulate the fluid pressure of the cleaning fluid coming from the cleaning fluid source. Finally, a shut-off valve is disposed to selectively initiate or terminate the flow of cleaning fluid from the cleaning fluid source.

The present invention further teaches a novel method for cleaning a portable keg tap. The method involves the following steps. First, a cleaning fluid is received from a cleaning fluid source. Next, the cleaning fluid is delivered to an inlet of the keg tap. Finally, the flow rate of the cleaning fluid flowing to the inlet is selectively controlled. The flow rate of the cleaning fluid may be selectively controlled by (1) selectively initiating and terminating the flow of the cleaning fluid and/or (2) selectively varying the cleaning fluid pressure flowing to the inlet.

Other objects, features, and advantages of the present invention will become apparent from the following description when considered in conjunction with the accompanying drawings.

BRIEF DESCRIPTION OF THE DRAWINGS

The present invention, as defined in the claims, can be better understood with reference to FIG. 1.

DETAILED DESCRIPTION OF THE PREFERRED EMBODIMENT

Figure 1:
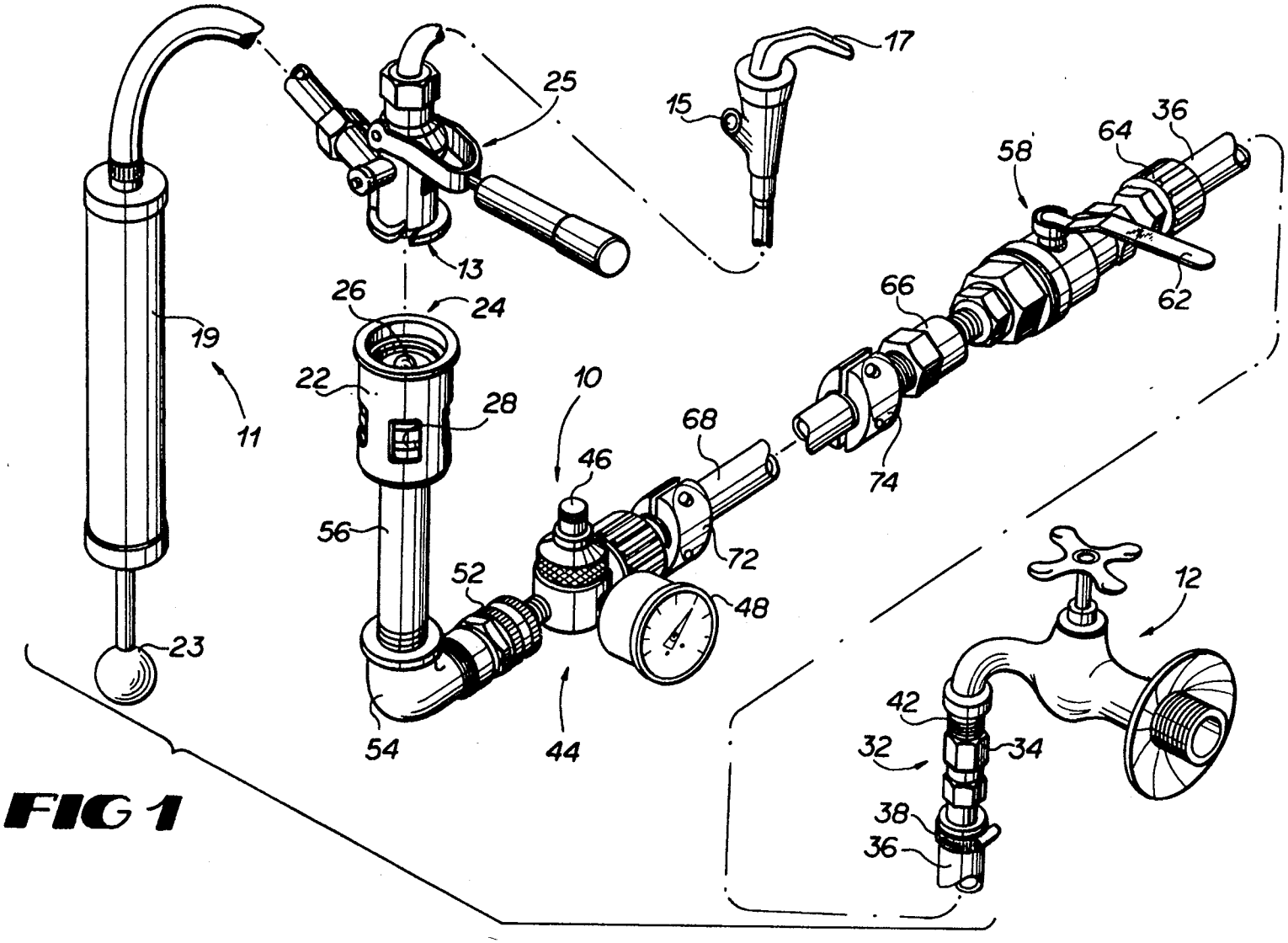
FIG. 1 illustrates a perspective view of the cleaning apparatus in accordance with the present invention. It should be noted that the drawings of FIG. 1 are not necessarily to scale, emphasis instead being placed upon clearly illustrating principles of the present invention.

As shown in FIG. 1, a novel cleaning apparatus 10 in accordance with the present invention is used to couple a cleaning fluid source 12 to the inlet orifice 13 of the conventional keg tap 11 for the purpose of passing cleaning fluid through the internal fluid passage ways of the keg tap 11 and out of the controllable dispensing outlet 15.

The cleaning apparatus 10 has a keg tap coupling 22 with an orifice 24 which emulates a fluid outlet orifice of a conventional keg (not shown). As a result, the keg tap coupling 22 can be detachably connected to the inlet 13 of the keg tap 11. Specifically, in the preferred embodiment, the keg tap coupling 22 comprises a spring-loaded ball 26 under the force of a spring 28, which acts like a check valve for impeding the flow of cleaning fluid. As the keg tap 11 is engaged with the keg tap coupling 22, the ball 26 is forced inwardly so as to provide a throughway for the cleaning fluid.

It should be emphasized that other configurations for the coupling 22 are possible. In particular, one which would interface with a keg tap having a two-prong inlet are possible and are intended to be within the scope of the present invention. In a keg tap 11 having a two-prong inlet, one prong-like tube is dedicated to air, while the other prong-like tube is allocated to the beverage. In this case, the coupling 22 is adapted to pass cleaning fluid through the prong-like tube allocated to the beverage.

Furthermore, a cleaning fluid coupling 32 is disposed for connecting the other end of the cleaning apparatus to a cleaning fluid source 12, for example, a water spigot as shown. It should be noted that the cleaning fluid source 12 could comprise any number of mechanisms for supplying a cleaning fluid. As another example, the cleaning fluid source 12 could comprise a conventional hot water heater to enhance the cleansing effect and/or solubility of foreign materials. The cleaning fluid coupling 32 could connect to the hot water outlet of the conventional hot water heater.

Moreover, the cleaning fluid source 12 could deliver cleansing solvents or other reactive chemical solutions which provoke a chemical reaction with the build-up of foreign materials.

The cleaning fluid coupling 32 has an adaptor 34 permitting connection of a hose 36 to the cleaning fluid source 12. A pipe clamp 38 ensures proper engagement of the hose 36 about the adaptor 34. Moreover, the adaptor 34 is engaged by threads 42 to the cleaning fluid source 12.

The preferred embodiment further comprises a fluid regulator 44 adapted to regulate the flow rate and pressure of the cleaning fluid passing through the cleaning apparatus 10. The fluid regulator 44 comprises a fluid adjustment 46 which increases or decreases the throughway pertaining to the cleaning fluid. Furthermore, the pressure within the cleaning apparatus 10 can be monitored via a pressure gauge 48. The user can adjust the pressure so that the keg tap 11 is not damaged or forcibly disengaged from the keg tap coupling 22. The fluid regulator 44 is connected to the keg tap coupling 22 via a pipe adaptor 52, a pipe elbow 54, and a pipe nipple 56, as shown in FIG. 1.

In accordance with another feature of the preferred embodiment, the cleaning apparatus 10 may further include a shut-off valve 58 with valve lever 62 for selectively initiating and terminating the flow of the cleaning fluid traveling through the cleaning apparatus 10. The shut-off valve 58 is connected at one end to the hose 36 by means of an adaptor 64. At the other end, the shut-off valve 58 is connected to the fluid regulator 44 via a pipe adaptor 66 and a pipe 68. The pipe 68 is connected to the fluid regulator 44 at one end by a clamping mechanism 72, and at the other end, is connected to the pipe adaptor 66 via a clamping mechanism 74.

In operation, the keg tap coupling 22 is connected to the inlet 13 of any conventional keg tap. Further, the cleaning fluid coupling 32 is connected to a cleaning fluid source 12. Cleaning fluid can then be passed from the cleaning fluid source 12 through the cleaning apparatus 10 and then through the internal fluid passage ways of the keg tap 11. As cleaning fluid flows through the cleaning apparatus 10, the cleaning fluid can be selectively controlled to optimize the cleaning effect. The cleaning fluid may be selectively initiated and terminated via the shut-off valve 58. Such an action could result in a desirable agitation or variable thrust of the cleaning fluid for cleansing the keg tap inlet 13 as well as other throughway components. Furthermore, the fluid regulator 44 can regulate the fluid pressure of the cleaning fluid to thereby enhance the force with which the cleaning fluid travels through the keg tap. Increased pressure and pressure variations enhance the solubility of foreign materials.

It will be obvious to those skilled in the art that many variations may be made to the preferred embodiment described above without departing from the novel teachings of the present invention. All such variations are intended to be incorporated herein and within the scope of the present invention.

Wherefore, the inventors claim the following:

1. A method for cleaning portable keg taps, comprising the steps of:

(a) providing a portable cleaning apparatus comprising:
  (1) a coupling means for receiving water from a water spigot and for delivering the water to an inlet of a singular portable keg tap;
  (2) a shut-off valve adapted to turn on and off the flow of the water through the coupling means;
  (3) a regulating means for regulating the pressure of the water in the coupling means;
  (4) means for detachably coupling said coupling means and said water spigot; and
  (5) means for detachably coupling said coupling means and said keg tap;

(b) connecting the portable cleaning apparatus to said water spigot and to said portable keg tap;

(c) cleaning the portable keg tap by delivering water from said water spigot to said inlet of said portable keg tap;

(d) controlling the flow of said water flowing to said inlet by controlling said valve and said regulating means; and (e) after cleaning said portable keg tap, disconnecting said portable cleaning apparatus from both said water spigot and said portable keg tap.

* * * * *